United States Patent [19]

Erana

[11] Patent Number: 4,977,944

[45] Date of Patent: Dec. 18, 1990

[54] CORE BLOWING MACHINE

[76] Inventor: Agustín A. Eraña, Zorrestea, 4 Polígono Ind. Ali-Gobeo, 01010 Vitoria Alava, Spain

[21] Appl. No.: 307,405

[22] Filed: Feb. 7, 1989

[30] Foreign Application Priority Data

Feb. 12, 1988 [ES] Spain ..... 8800401

[51] Int. Cl.[5] ..... B22C 11/08; B22C 19/00

[52] U.S. Cl. ..... 164/186; 164/228

[58] Field of Search ..... 164/180, 186, 200, 228, 164/233

[56] References Cited

U.S. PATENT DOCUMENTS

| | | | |
|---|---|---|---|
| 3,888,299 | 6/1975 | Bardet | 164/228 |
| 3,994,333 | 11/1976 | Linneweh et al. | 164/186 X |
| 4,411,586 | 10/1983 | Zitser et al. | 164/180 X |
| 4,637,450 | 1/1987 | Kawai et al. | 164/228 X |

FOREIGN PATENT DOCUMENTS

| | | | |
|---|---|---|---|
| 2444332 | 3/1976 | Fed. Rep. of Germany | 164/186 |
| 194277 | 5/1967 | U.S.S.R. | 164/228 |
| 939161 | 6/1982 | U.S.S.R. | 164/186 |
| 1212352 | 11/1970 | United Kingdom | 164/228 |

*Primary Examiner*—Richard K. Seidel
*Assistant Examiner*—J. Reed Batten, Jr.
*Attorney, Agent, or Firm*—Helfgott & Karas

[57] ABSTRACT

In a core blowing machine, a core collecting device including a plurality of core collecting trays is provided, which is positioned at a core removal area of the machine and comprises a support bed on which a first set of guides is provided for guiding a carriage in a longitudinal direction thereof. A frame common for all core collecting trays is integrally connected to the carriage. The frame has a second set of guides which are transversal to the first set. A slide block is positioned on each pair of transversal guides and a tilting support holding the corresponding tray is fitted on each slide block. A tilting cylinder is provided for each tray, which is connected between the slide block and the support. A displacement cylinder for the slide blocks, which connects the latter to the frame, and a further cylinder for the displacement of the carriage, connecting the carriage to the support bed are further provided so that each tray, and consequently each core, may be displaced longitudinally, transversally and tilted from a horizontal position to a vertical position.

3 Claims, 2 Drawing Sheets

CORE BLOWING MACHINE

BACKGROUND OF THE INVENTION

The present invention relates to a core blowing machine, and more specifically to improvements introduced in the devices related to the core collecting trays, after the cores are formed by the machine, in order that such cores are correctly positioned, with respect both to the specific positioning of each of the cores and the relative positioning therebetween and, consequently, that they leave the blowing machine in the correct position for assembly therebetween.

It is a well known fact that all core blowing machines consist of a core box divided into two parts which may be coupled horizontally or vertically. Superposition of the two parts of the core box defines hollows which produce the cores themselves when filled with agglomerating sand. The sand is introduced into the core box by the dragging effect of air under pressure, such sand being located in the so-called blowing cartridge which is superposed and coupled to the core box, such that the release of air under pressure leads the sand from the cartridge to the interior of the box.

Therefore, once the sand has passed from the cartridge into the core box and the hollows defined therein have been filled, the cartridge is withdrawn and the so-called gassing plate is then coupled to the box, a catalyst gas being injected through such plate causing the agglomerating resin to polymerize quickly and, consequently, the cores to harden.

Once the cores have hardened, the box is opened and ejectors, which are generally mechanical, extract the cores from the part of the box they are located in, and place them in containers provided for such purpose.

After this stage the cores may be handled manually or using automatic handlers to transport and place them in a suitable position, and in the necessary order, so that they may be assembled and be firmly fixed to each other to form the block through any of the previously mentioned means or systems, such as through casting, sand blowing, metal banding, threaded braces, etc.

In short, cores produced in any blowing machine are merely placed in containers, in any position or order, it therefore being necessary before reaching the base for assembly and formation of the block to submit such cores to manifold manual or automatic movements or operations, so as to place them in a vertical position leaning on their bases, and to duly insert them and, finally, to convey them to another area of the installation where a suitable machine will duly join or assemble the cores to form the block, either through casting, metal banding, threaded braces, sandramming or any other means.

These operations which have to performed between the stage when the cores themselves are deposited by the blowing machine, and when such cores are duly interrelated in order that they may be fixed to form the definitive block, obviously imply manifold manual operations and, if such operations are performed automatically, the use of machines and handlers which render the installation increasingly complex and costly is necessary.

SUMMARY OF THE INVENTION

A blowing machine in accordance with the invention fully solves the aforementioned problems since, through the provision of a new core collecting device, the cores may be placed in a correct position and order so they may be supplied directly to the machine or apparatus which shall assemble and join the block by any of the previously mentioned means without any other complementary accessory or handling being necessary.

More specifically, and in order to achieve the above, the blowing machine comprises a carriage which may slide on guides positioned in the chassis of the machine, a frame provided with the same number of pairs of guides as there are core collecting trays in the blowing machine being integral with such carriage, the frame guides being transversal, i.e., perpendincular to the guides on which the carriage slides, and each pair of guides being provided with a slide block positioned thereon, such slide block being in turn hingedly fitted with a support to which the corresponding tray is stiffened. Such tray is removably connected to the support so that the trays may be substituted and therefore adjusted to any shape and size of the cores which they must receive.

As a complement to the structure described, a hydraulic cylinder is provided between each slide block and the corresponding support which provides the tilting movement of the tray, and each slide block may in turn be fitted with a further hydraulic cylinder for displacement of such slide block on its guides, longitudinal displacement of the carriage on corresponding guides also taking place with the help of another hydraulic cylinder.

In accordance with a further aspect of the invention, the carriage may move in and out of the blowing machine. When moving in all the trays are arranged horizontally so as to receive the corresponding cores, and after collecting such cores, the carriage leaves the machine and moves to face a handler of any conventional type, after duly tilting any one or all of its trays for each core to adopt a correct position with a view to its subsequent assembly, and through longitudinal displacements of the carriage and transversal displacements of each tray, each core may adopt any relative position with respect to the other cores at the stage when they are held by the handler which shall move them on to the following stage where they will be joined to each other.

In order to complement the description being made and to assist a better understanding of the characteristics of the invention, a set of drawings is attached to the present specification, as an integral part thereof.

DETAILED DESCRIPTION OF THE PREFERRED EMBODIMENTS

Figures 2, 3:
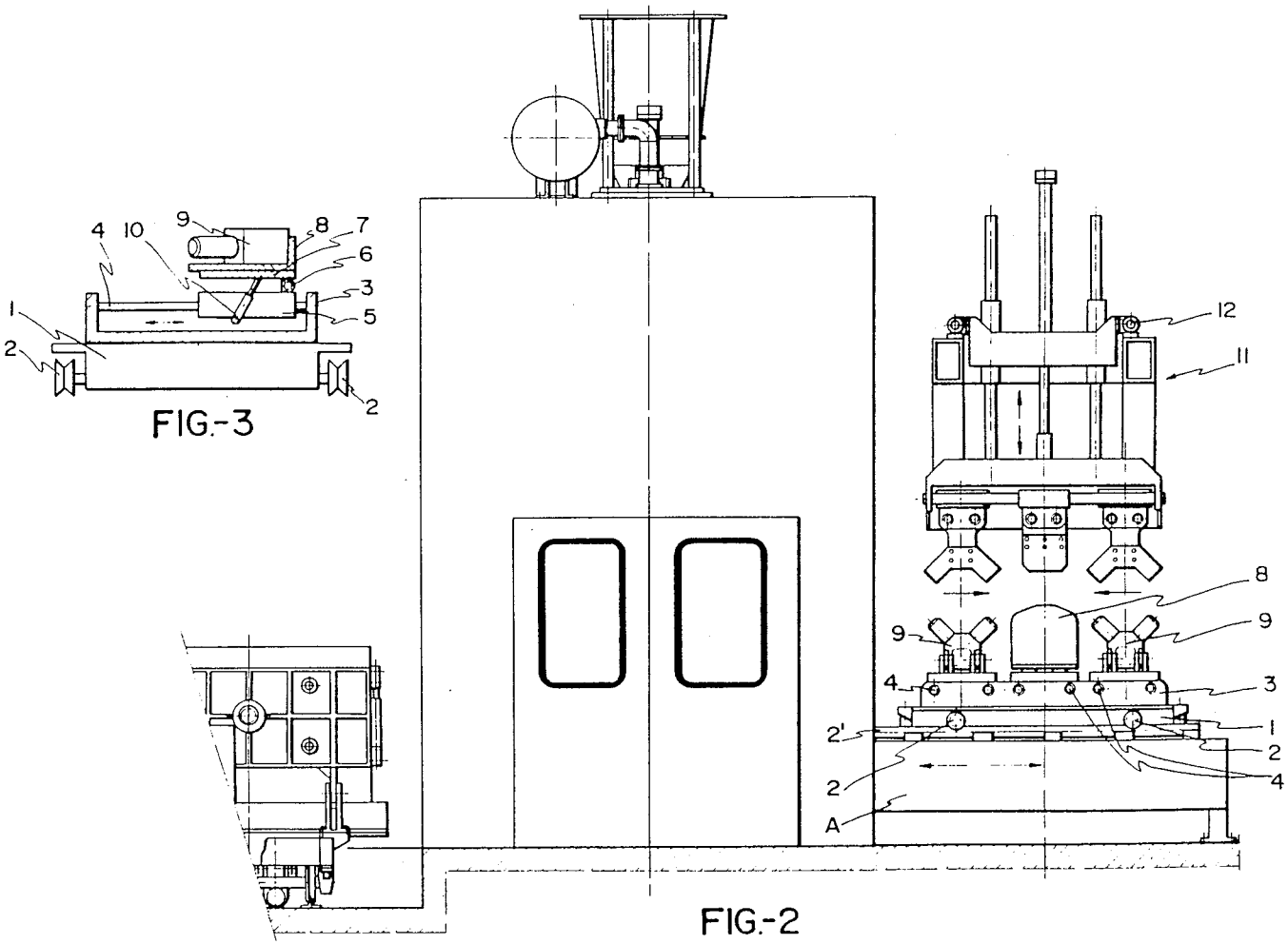
FIG. 2 is a side elevational view, at an angle of 90° with respect to the figure, showing the carriage fitted with the support provided with the guides, on which the frames, to which the tray supports are linked, slide.
FIG. 3 shows a sectional view of a detail of the device itself which allows displacement and tilting of the core collecting trays according to the present invention.

Referring now to the drawings in detail it may be observed that a core blowing machine in accordance with the present invention, and irrespective of the devices inherent in the blowing process itself and which are beyond the scope of the present invention, is provided with a device related to core collecting trays, which device comprises a carriage 1, fitted with wheels or sheaves 2 for its displacement on guides 2' which are operatively positioned on a support bed A, carriage 1 defining a top platform to which a frame 3, having a grooved profile, is fixed. A plurality of pairs of transversal guides 4 are positioned in the grooved profile of the frame 3, the number of pairs being the same as the number of trays to be provided in the blowing machine, guides 4 (FIG. 3) for two slide blocks to slide on, each slide block being hingedly fitted at 6 with a support 7 for the corresponding tray 8, which shall collect cores 9 when in a horizontal position, each tray 8 adopting a dihedral and straight profile, and being removably fitted on support 7 in order that it may be substituted and adjusted in each case to the size and shape of core 9. The support 7 of each tray 8 further being operatively connected to corresponding slide block 5 by a hydraulic cylinder 10 capable of providing a corresponding tray 8 with the necessary tilting movements in order to change from a horizontal position to a vertical position and vice versa. Complementarily, each slide block 5 is provided with a further hydraulic cylinder which allows such slide block to slide on guides 4 in the direction of the arrows shown in FIG. 3. Such further cylinder may be integrated in slide block 5 itself, its rod acting on frame 3, or vice versa. The device is further provided with yet another hydraulic cylinder, which is not shown in the drawings, and which moves carriage 1 on guides 2' in the direction arrows shown in FIG. 2.

Figure 1:
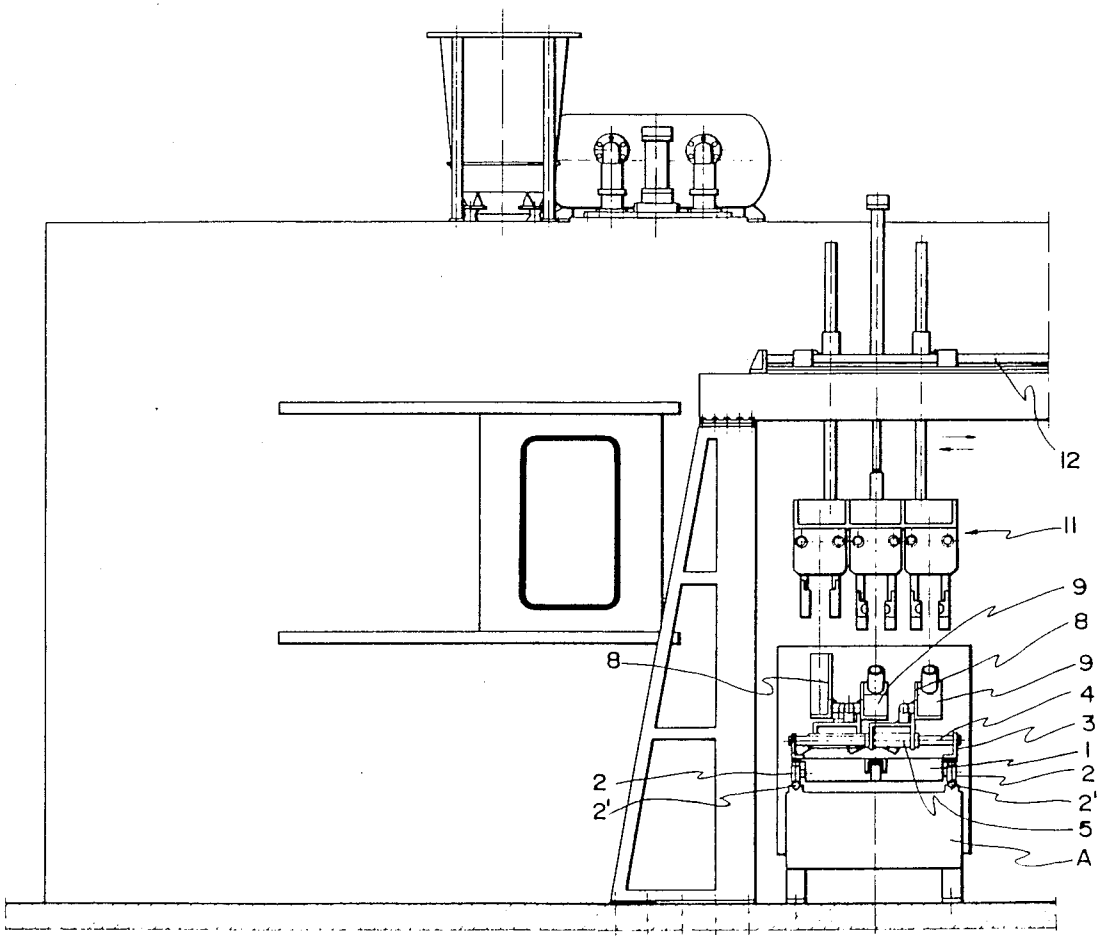
FIG. 1 is a schematic view of one part of the conventional blowing machine with the improvements introduced therein.

In accordance with this structure, carriage 1 may move in and out of the blowing machine, so that trays 8, when in a horizontal position, may reach the area where they will collect corresponding cores 9, and after receiving them, move under a handler 11, of any suitable conventional type, with respect to which each core may adopt any position required, specifically due to the fact that the cores may be displaced in a longitudinal direction when carriage 1 moves, due to the fact that they can be displaced transversally, when slide block 5 corresponding to each core is displaced and due to the change in position of each core 9, specifically through tilting of corresponding tray 8. This device therefore allows the correct position of each core to be established as regards orientation and relative positioning between the different cores, such that the latter may be moved by handler 11 to the stage where the corresponding block will be formed, using any means to fix the cores to each other, without any manual intervention and the use of any other accessory device other than the handler 11 being necessary for transfer thereof on guides 12 and in accordance with the arrows shown in FIG. 1.

It is not considered necessary to extend the present description any further for an expert in the art to understand the scope of the invention and the advantages derived therefrom.

The materials, shape, size and arrangement of the elements may vary, provided this does not imply a modification in the essentiality of the characteristics of the invention.

The terms used to describe the present specification should be understood to have a wide and non-limiting meaning.

I claim:

1. In a core blowing machine for forming and assembling cores to form a block, comprising a core collecting device including trays for collecting individually formed cores, wherefrom cores are moved to a device for joining cores to each other to form the block and placed in due order and position, the improvement comprising said core collecting device including a support bed having first guides thereon, a carriage which is guided on said first guides in a first direction lengthwise of said carriage and longitudinally with respect to an area where the blowing machine deposits individual cores, a frame which is common to all said core collecting trays and integral with said carriage, second guides positioned in said frame, a plurality of slide blocks adapted to slide on said second guides in a second direction tranversal to said first direction, and a plurality of tray supports each hingedly connected to a respective slide block so that each tray support can be tilted between a horizontal position and a vertical position, each core collecting tray being connected to a respective one of said supports; and a handler for receiving the cores from said core collecting device to transfer the cores to a block shaping device of the blowing machine, whereby a group of core collecting trays is displaceable in a longitudinal direction with respect to said area while each core collecting tray is displaceable in the direction transversal to said longitudinal direction to adopt any relative position in respect to other core collecting trays, and each tray is displaceable to assume a horizontal position to receive the cores at said area and a vertical position to supply the cores to said handler.

2. The core blowing machine according to claim 1, further comprising a first hydraulic cylinder provided between each tray support and the respective slide block to impart a tilting movement to each tray support, a second hydraulic cylinder to displace said slide blocks in said second direction and a third hydraulic cylinder positioned at said support bed to impart to said carriage movements in said first direction.

3. The core blowing machine according to claim 2, wherein each core collecting tray is removably-connected to the respective tray support to enable replacement and adjustment of the core collecting trays to a shape and a size of the cores produced in the blowing machine.

* * * * *